US005337678A

United States Patent [19]

Grout

[11] Patent Number: 5,337,678

[45] Date of Patent: Aug. 16, 1994

[54] ADJUSTABLE DESK FRAME

[75] Inventor: John E. Grout, Castlecrag, Australia

[73] Assignee: Ergonomic Equipment Pty. Ltd., New South Wales, Australia

[21] Appl. No.: 27,233

[22] Filed: Jan. 7, 1993

[51] Int. Cl.[5] ..... A47B 9/00

[52] U.S. Cl. ..... 108/147; 108/144

[58] Field of Search ..... 108/144, 145, 146, 147

[56] References Cited

U.S. PATENT DOCUMENTS

| | | | |
|---|---|---|---|
| 2,249,455 | 7/1941 | Caldwell | 108/147 |
| 3,105,246 | 10/1963 | Emrick | 108/147 |
| 4,590,865 | 5/1986 | Rutsche et al. | 108/147 |
| 4,593,874 | 6/1986 | Dunagan | 108/147 |
| 5,022,327 | 6/1991 | Solomon | 108/147 |

*Primary Examiner*—Kenneth J. Dorner
*Assistant Examiner*—Gerald A. Anderson
*Attorney, Agent, or Firm*—Ladas & Parry

[57] ABSTRACT

A frame for a desk to support a work surface for height adjustment of the work surface. The frame includes a base frame consisting of a pair of vertical members which are generally parallel, co-extensive and transversely spaced. The vertical members of the base frame receive a pair of vertical members of a height adjustable sub frame. A rotatably driven first shaft causes vertical movement of an associated pair of vertical members on one side of the desk while vertical movement is transferred to the other side of the desk by a second shaft having gears which engage a rack gear on each of the vertical members of the sub-frame.

8 Claims, 4 Drawing Sheets

ADJUSTABLE DESK FRAME

TECHNICAL FIELD

The present invention relates to desk frames and more particularly to adjustable desk frames which have a top work surface which is height adjustable.

BACKGROUND OF THE INVENTION

The present invention relates to improvements in the adjustable desk frame disclosed in U.S. Pat. No. 4,850,563.

Desk frames in their assembled state occupy a considerable volume and therefore are costly to transport. This problem has been addressed by the desk frame disclosed in the above cited patent.

Adjustable frames are also disclosed in U.S. Pat. Nos. 732,436, 1,915,802, 1,957,785, 2,829,928, 3,140,559, and 4,627,364, as well as German specification 225350. However the frames disclosed in these documents are generally complex and do not lend themselves for incorporation in a frame which is to be transported in a disassembled state.

SUMMARY OF THE INVENTION

There is disclosed herein a frame to support a work surface so that the work surface is adjustable in height, said frame comprising:

a base to rest upon a floor and including a pair of vertical members which are transversely spaced, generally parallel and co-extensive;

a sub-frame supported on the base for adjustable vertical movement relative thereto and to support the work surface, said sub-frame including a pair of vertical members guidably supported by the base vertical members, the sub-frame vertical members being transversely spaced, generally parallel and co-extensive and arranged with respect to the vertical members of the base so that each vertical member of the base has an associated one of the vertical members of the sub-frame; and drive means operable by a user to adjust the height of the sub-frame while maintaining said work surface in a desired orientation, said drive means including a vertical first shaft extending between the base and sub-frame and being mounted in or adjacent to an associated pair of vertical members for rotation about its longitudinal axis, thrust means mounting said shaft in said sub-frame, a nut mounted on said base so as to be fixed thereto and threadably engaged by said shaft, whereby rotation of said shaft causes longitudinal movement of said shaft and movement between the vertical members of said associated pair, a rack gear mounted in each of the vertical members of said sub-frame, a horizontal second shaft extending between the vertical members of said base and rotatably mounted therein, a pair of gears fixed to said second shaft and each engaged with an associated one of the rack gears so that the vertical members of said sub-frame move in unison.

BRIEF DESCRIPTION OF THE DRAWINGS

A preferred form of the present invention will now be described by way of example the reference to the accompanying drawings, wherein.

DETAILED DESCRIPTION OF THE PREFERRED EMBODIMENT

Figure 1:
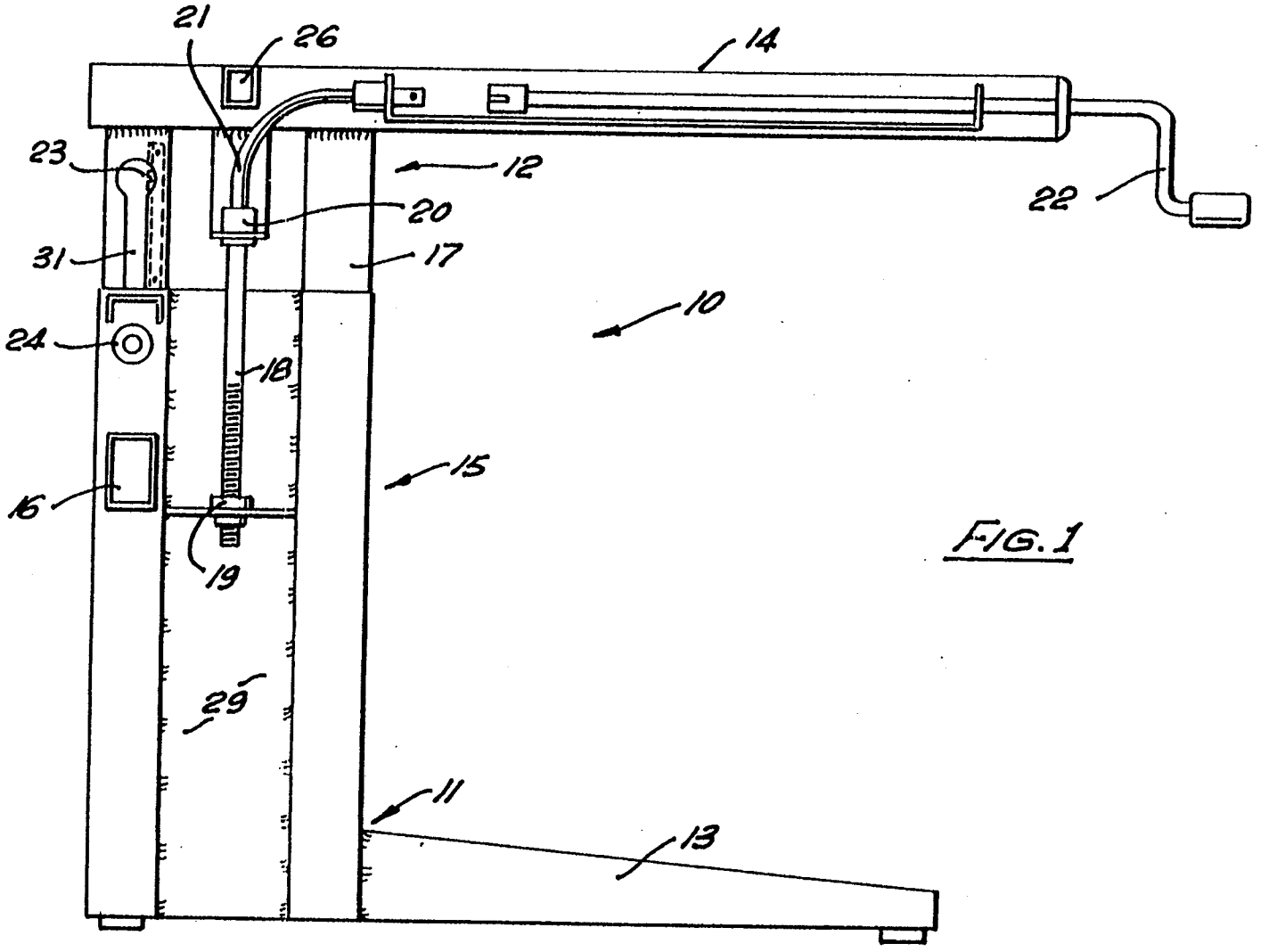
FIG. 1 is a schematic side elevation of a desk frame.
Figure 2:
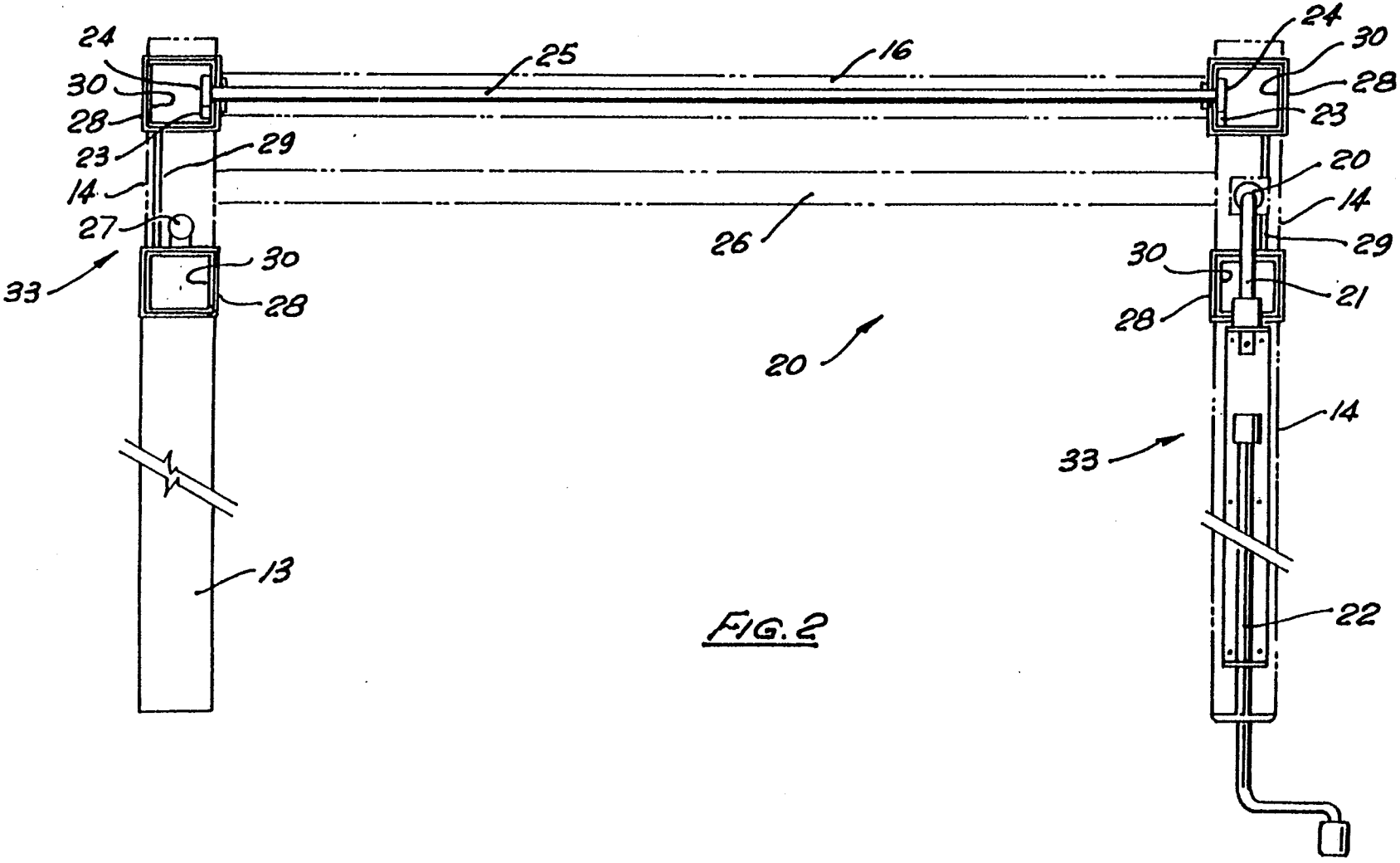
FIG. 2 is a schematic plan view of the desk frame of FIG. 1.
Figure 3:
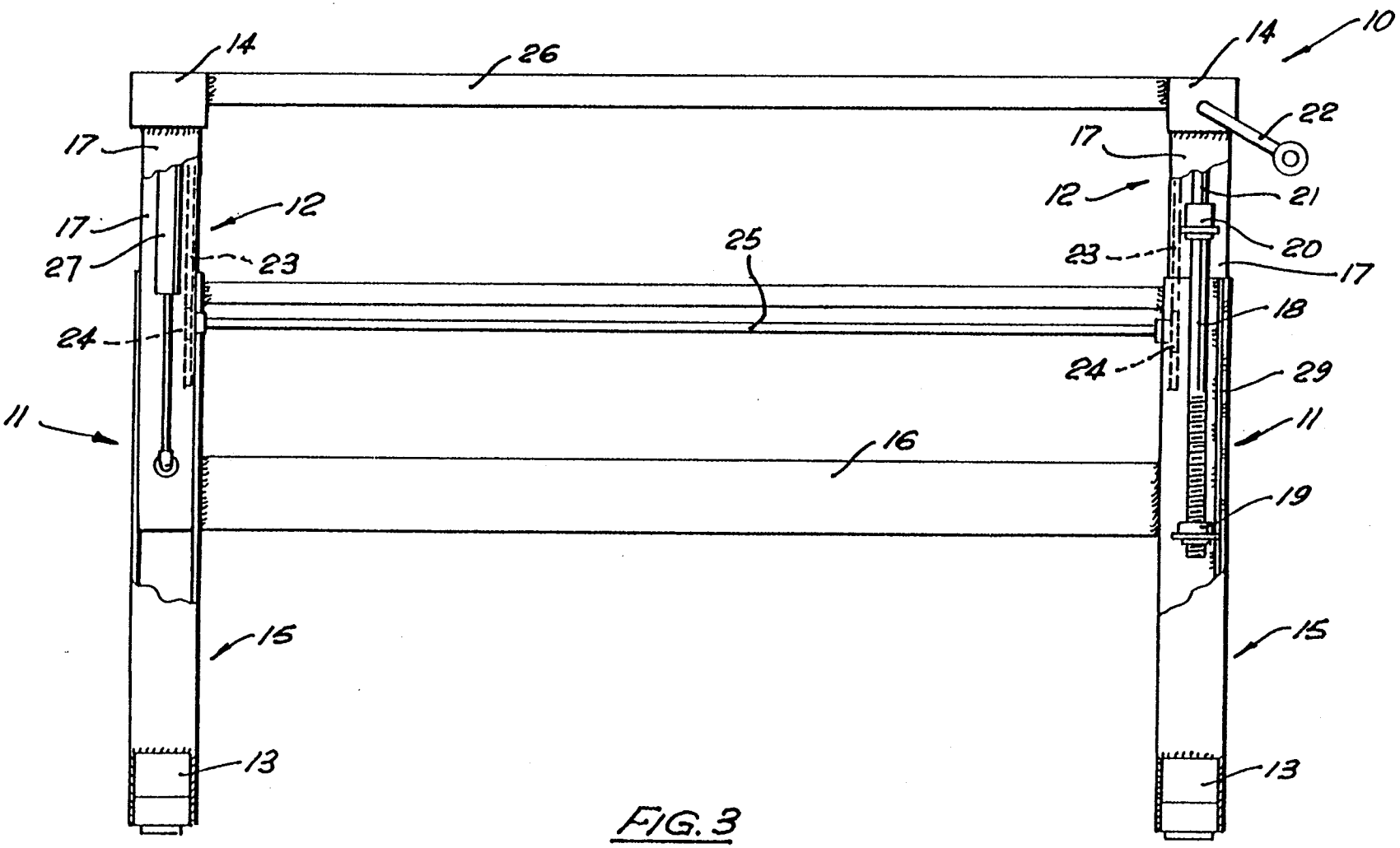
FIG. 3 is a schematic front elevation of the desk frame of FIG. 1.

In the accompanying drawings there is schematically depicted an adjustable desk frame 10 having a floor engaging base frame 11 and a vertically movable sub-frame 12. The sub-frame 12 and base frame 11 have co-operating channel surfaces which slidably guide movement of the sub-frame 12 relative to the base frame 11. The sub-frame 12 is provided with horizontal members 14 to support a desk top.

The base frame 11 also has horizontal members 13 which aid in mounting the base frame 11 on a floor surface.

The base frame 11 has a pair of vertical members 15 which are transversely spaced, generally parallel and co-extensive. A brace 16 extends between the members 15.

The sub-frame 12 has a pair of vertical members 17 which are also transversely spaced, generally parallel and co-extensive. Each member 17 is telescopically received within an associated member 15 so that the vertical members are arranged tn co-operating pairs, each pair being positioned on a side of the desk frame 10.

Extending between an associated pair of vertical members 15 and 17 is a rotatable first shaft 18 which is threaded and threadably engages a nut 19 fixed to the base frame 15. The upper end of the shaft 18 is mounted in a thrust bearing 20 mounted in the sub frame 12. Accordingly rotation of the shaft 18 causes longitudinal movement of the shaft 18 and therefore vertical movement of the member 17 relative to the member 15. The shaft 18 is rotated by means of a flexible drive shaft 21 extending to a crank handle 22. Alternatively, the shaft 18 could be driven by means of an electric motor.

Mounted in each member 17 is a rack gear 23 while engaged with the rack gears 23 are gears 24. The gears 24 are caused to rotate in unison by being fixed to a horizontal second shaft 25. Accordingly movement is transferred from one side of the desk frame 10 to the other side. Accordingly the vertical members 17 are raised and lowered in unison to maintain the work surface in a generally horizontal orientation or, a desired orientation.

In the above described embodiment, the brace 16, and a further brace 26 are welded to the base frame 11 or the sub-frame 12.

To aid in lowering the sub-frame 11, there is provided a gas strut 27 which is fixed at one end to the sub-frame, and at the other end to the base frame. In this embodiment, only one gas strut is provided and it is included in the associated pair of members 15 and 17 which do not house the shaft 18.

Figure 4:
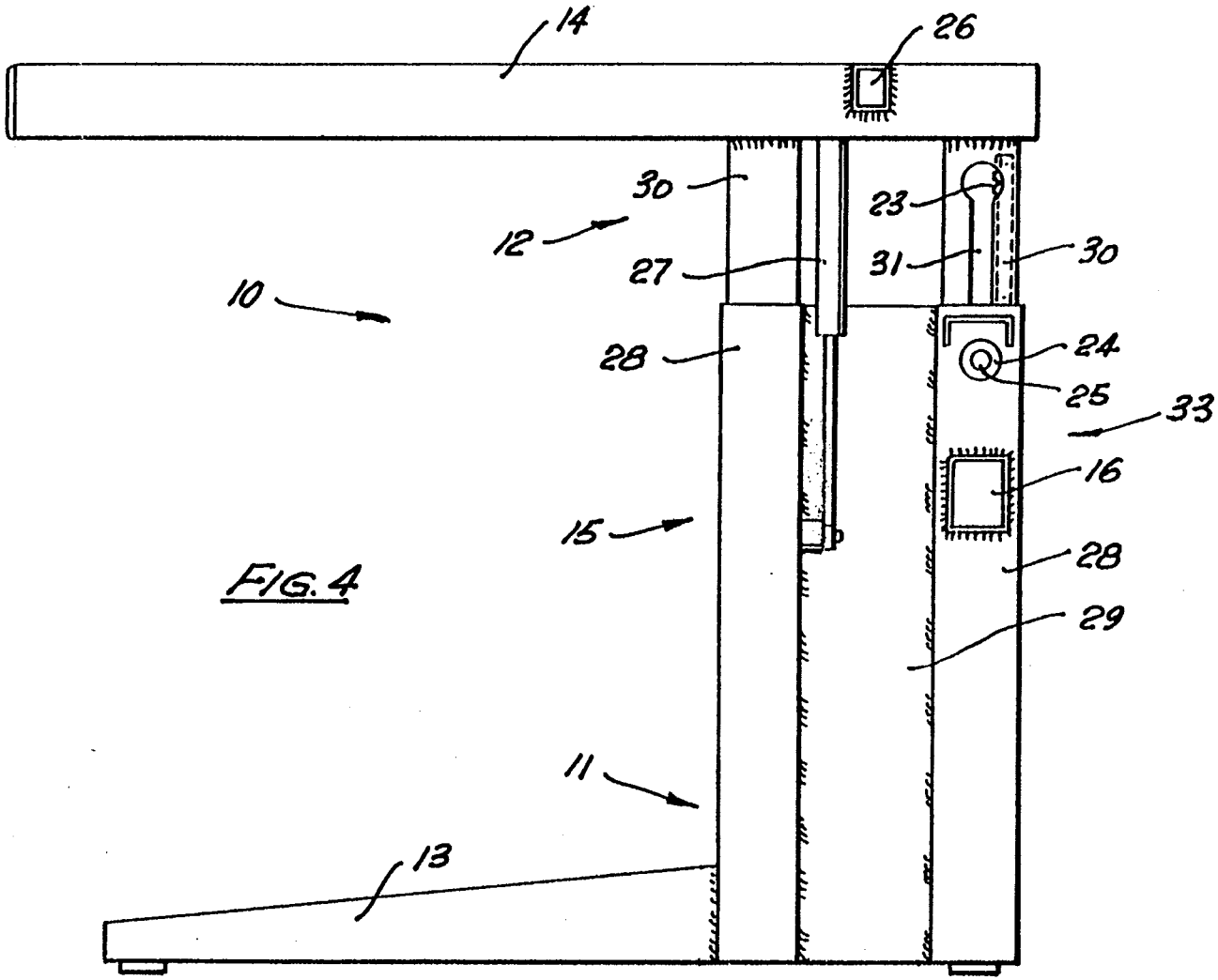
FIG. 4 is a schematic further side elevation of the desk frame of FIG. 1.

Each member 15 includes a pair of channel or tubular portions 28 joined by a web 29. Each member 17 includes a pair of tubular portions 30 each telescopically associated with one of the portions 28. As best seen in FIG. 4, the gas strut 27 is spaced toward one of the tubular portions 30 while the rack gear 23 is fixed to the other tubular portion 30. The tubular portions 30 are provided with longitudinal slots 31 through which the shaft 25 may pass. The slot 31 has an enlarged portion 32 which enables the gear 24 to be inserted into the associated tubular portion 30 so as to engage the associated rack gear 23.

As best seen in FIG. 1, the nut 29 is attached to or is positioned adjacent to the web 29. As an alternative construction, the shaft 18 could extend downwardly through an associated pair of portions 28 and 30. More particularly, the shaft 18 would extend down through the associated pair of portions 28 and 30 spaced toward the seat position of the desk, that is not the associated portions 28 and 30 which have the gears 23 and 24.

The above described desk 10 is intended to be transported in a disassembled state. That is the two side frame assemblies 33 are provided in an assembled state and the cross braces 16 and 26 are welded thereto when assembly is required. The shaft 25 and its associated gears 24 are also incorporated tn the assembly at that stage.

What I claim is:

1. A frame to support a work surface so that the work surface is adjustable height, said frame comprising:

a base to rest upon a floor and including a pair of vertical members in which are transversely spaced, generally parallel and co-extensive;

a sub-frame supported on the base for adjustable vertical movement relative thereto and to support the work surface, said sub-frame including a pair of vertical members guidably supported by the base vertical members, the sub-frame vertical members being transversely spaced, generally parallel and co-extensive and arranged with respect to the vertical members of the base so that each vertical member of the base is engaged with a respective one of the vertical members of the sub-frame to form a respective pair of vertical members; and drive means operable by a user to move the vertical members of the sub-frame thereby to adjust the height of the work surface while maintaining said work surface in a desired orientation, said drive means including a vertical first shaft extending between the base and sub-frame in proximity to an associated pair of vertical members for rotation about a longitudinal axis of said first shaft, thrust means supporting said shaft on said sub-frame, a nut mounted on said base so as to be fixed thereto and threadably engaged by said shaft, whereby rotation of said shaft causes longitudinal movement of said shaft and movement between the vertical members of said associated pair of vertical members, a rack gear mounted on each of the vertical members of said sub-frame, a horizontal second shaft extending between the vertical members of said base and rotatably mounted therein, and a pair of gears fixed to said second shaft, each gear being engaged with an associated one of said rack gears so that the vertical members of said sub-frame move in unison.

2. The frame of claim 1, wherein the vertical members of each said pair thereof are telescopically engaged.

3. The frame of claim 2, further including a gas strut connected to the vertical members of one of said pairs of vertical members to aid in moving the sub-frame relative to the base.

4. The frame of claim 1, wherein said sub-frame includes generally horizontally extending members which support said work surface, and said drive means includes a flexible drive shaft having a generally horizontal portion extending generally parallel to said horizontal members, and a vertical portion engaging an end of said first shaft to cause rotation thereof upon rotation of the flexible drive shaft.

5. The frame of claim 4, wherein said drive means further comprises a drive member connected to the horizontal portion of said flexible drive shaft for rotating said flexible drive shaft.

6. The frame of claim 5, wherein said drive member comprises a crank handle.

7. The frame of claim 1, comprising a brace connecting the vertical members of the base.

8. The frame of claim 1, wherein two said pairs of said vertical members are provided at opposite sides of said work surface, and a web is provided at each of said sides to connect together the vertical members of said base thereat.

* * * * *